US010415809B2

(12) United States Patent
Thomas et al.

(10) Patent No.: US 10,415,809 B2
(45) Date of Patent: Sep. 17, 2019

(54) DIRECTIONAL ACCENT LUMINAIRE WITH JUNCTION BOX

(71) Applicant: Hubbell Incorporated, Shelton, CT (US)

(72) Inventors: Jason Thomas, Mesa, AZ (US); Agus The, Mesa, AZ (US)

(73) Assignee: Hubbell Incorporated, Shelton, CT (US)

( * ) Notice: Subject to any disclaimer, the term of this patent is extended or adjusted under 35 U.S.C. 154(b) by 74 days.

(21) Appl. No.: 15/466,398

(22) Filed: Mar. 22, 2017

(65) Prior Publication Data

US 2017/0276337 A1 Sep. 28, 2017

Related U.S. Application Data

(60) Provisional application No. 62/311,665, filed on Mar. 22, 2016.

(51) Int. Cl.

| | |
|---|---|
| ***F21V 23/00*** | (2015.01) |
| ***F21V 15/01*** | (2006.01) |
| ***F21W 131/10*** | (2006.01) |
| ***F21Y 115/10*** | (2016.01) |
| ***F21V 21/30*** | (2006.01) |

(52) U.S. Cl.

CPC ..... *F21V 23/002* (2013.01); *F21V 15/01* (2013.01); *F21V 23/009* (2013.01); *F21V 21/30* (2013.01); *F21W 2131/10* (2013.01); *F21Y 2115/10* (2016.08)

(58) Field of Classification Search

CPC ..... F21V 21/14; F21V 21/0824; F21V 21/30; F21V 23/002; F21V 23/009; F21V 15/01; F21W 2131/10; F21S 8/038; F21S 8/066

See application file for complete search history.

(56) References Cited

U.S. PATENT DOCUMENTS

| | | | | |
|---|---|---|---|---|
| 5,535,109 | A * | 7/1996 | Moore | F21S 2/00 362/267 |
| 5,702,177 | A * | 12/1997 | Lin | F21S 8/038 362/370 |
| 7,137,721 | B1 * | 11/2006 | Rao | F21V 21/0824 362/371 |
| 7,438,433 | B1 | 10/2008 | Steadman | |
| 8,480,268 | B2 | 7/2013 | Wilson | |
| 8,506,134 | B2 | 8/2013 | Wilson | |
| D748,838 | S * | 2/2016 | Brynjolfsson | D26/63 |
| 9,488,268 | B2 | 11/2016 | Wilcox | |

(Continued)

*Primary Examiner* — William N Harris

(74) *Attorney, Agent, or Firm* — Michael Best & Friedrich, LLP

(57) ABSTRACT

A multi-positionable outdoor luminaire includes a housing having a front portion including a front compartment, a rear portion extending from the front portion, and a wall positioned between the front portion and the rear portion. A cover is removably connected over the rear portion. A light emitter is positioned in the front compartment for emitting light. A control component is positioned in the front compartment for controlling the light emitter. An internal conductor is electrically connected to the control component and extends from the front portion into the rear portion. The rear portion includes a junction compartment for housing a connection between a power supply conductor and the internal conductor.

20 Claims, 7 Drawing Sheets

(56) References Cited

U.S. PATENT DOCUMENTS

| | | | | |
|---|---|---|---|---|
| 9,879,847 | B2 * | 1/2018 | Khubani | F21V 29/503 |
| 10,151,453 | B2 * | 12/2018 | Duckworth | F21V 15/01 |
| 10,161,577 | B2 * | 12/2018 | Casper | F21S 2/005 |
| 10,161,621 | B2 * | 12/2018 | Acampora | F21V 31/005 |
| 10,197,234 | B2 * | 2/2019 | Lentine | F21V 29/70 |
| 2006/0198153 | A1 * | 9/2006 | Chien | F21V 21/0824 362/382 |
| 2007/0171655 | A1 * | 7/2007 | Lai | F21V 21/0824 362/362 |
| 2007/0279921 | A1 * | 12/2007 | Alexander | F21V 29/70 362/368 |
| 2009/0040774 | A1 * | 2/2009 | Avila | F21V 21/28 362/371 |
| 2009/0213595 | A1 * | 8/2009 | Alexander | F21V 19/001 362/373 |
| 2010/0265715 | A1 * | 10/2010 | Winstanley | F21S 2/00 362/277 |
| 2012/0057352 | A1 * | 3/2012 | Wilcox | F21V 29/70 362/308 |
| 2015/0211720 | A1 * | 7/2015 | Toner | F21S 9/032 362/183 |
| 2015/0362157 | A1 * | 12/2015 | Beausoleil | F21S 6/004 362/232 |
| 2016/0320026 | A1 | 11/2016 | Duckworth | |
| 2017/0219188 | A1 * | 8/2017 | Veloskey | F21V 19/02 |
| 2018/0283663 | A1 * | 10/2018 | Zhang | F21V 21/06 |
| 2018/0328575 | A1 * | 11/2018 | Khubani | F21V 14/00 |

* cited by examiner

DIRECTIONAL ACCENT LUMINAIRE WITH JUNCTION BOX

RELATED APPLICATION(S)

This application is based on U.S. Provisional Application Ser. No. 62/311,665, filed Mar. 22, 2016, the disclosure of which is incorporated herein by reference in its entirety and to which priority is claimed.

FIELD

Various exemplary embodiments relate to light fixtures or luminaires, for example accent light fixtures designed to illuminate streets, paths, houses, landscapes, parking lots, or other indoor or outdoor areas.

BACKGROUND

Light fixtures, or luminaires, are used with electric light sources to provide an aesthetic and functional housing in both interior and exterior applications. One type of light fixture is an accent light, generally used for interior and exterior lighting of specific areas. Examples of interior areas can include accent lighting for stairs, displays, and artwork. Examples of exterior lighting can include lawns, homes, landscaping features, and pathways. In recent years, lighting applications, including area lights have trended towards the use of light emitting diodes (LEDs) as a light source in place of conventional incandescent and fluorescent lamps.

SUMMARY

According to an exemplary embodiment, a directional accent luminaire includes a housing having a front portion including a front compartment, a rear portion extending from the front portion, and a wall positioned between the front portion and the rear portion. A cover is removably connected over the rear portion. A light emitter is positioned in the front compartment for emitting light. A control component is positioned in the front compartment for controlling the light emitter. An internal conductor is electrically connected to the control component and extends from the front portion into the rear portion. The rear portion includes a junction compartment for housing a connection between a power supply conductor and the internal conductor.

According to another exemplary embodiment, a directional accent luminaire includes a housing having a front portion including a front compartment, a rear portion extending from the front portion, and a wall positioned between the front portion and the rear portion. A light emitter is positioned in the front compartment for emitting light. A control component is positioned in the front compartment for controlling the light emitter. An internal conductor is electrically connected to the control component and extends from the front portion into the rear portion. A cover is removably connected over the rear portion. A mounting component extends from the rear portion and has an opening extending therethrough in communication with the rear portion. The rear portion includes a junction compartment for housing a connection between a power supply conductor and the internal conductor.

Another exemplary embodiment is directed to a method of installing a luminaire. A power supply conductor is extended through a mounting device and a luminaire is positioned near the mounting device. The luminaire includes a housing having a front portion with a front compartment, a rear portion extending from the front portion and having a junction compartment, and a wall positioned between the front portion and the rear portion. A light emitter is positioned in the front compartment for emitting light. A control component is positioned in the front compartment for controlling the light emitter. An internal conductor is electrically connected to the control component and extends from the front portion into the rear portion. A mounting component extends from the rear portion having an opening extending therethrough and in communication with the rear portion. The power supply conductor is run through the mounting component and into the junction compartment. The power supply conductor is spliced to the internal conductor in the junction compartment. A cover is connected to the rear portion over the junction compartment. The mounting device is connected to the mounting component through a rotatable connection.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
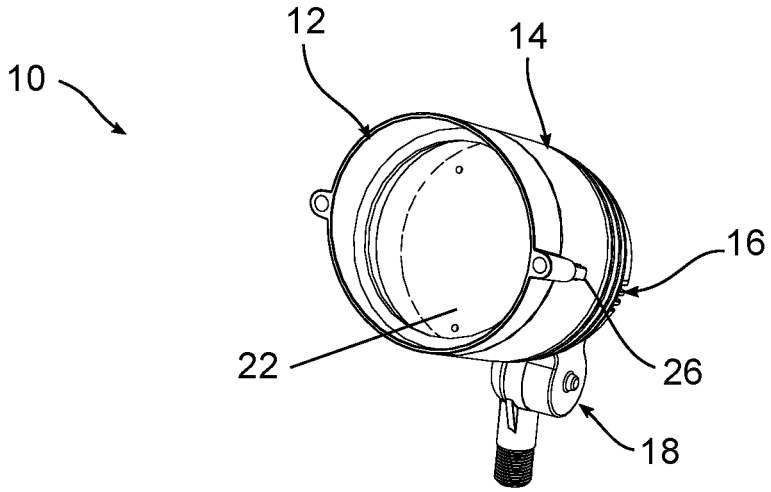
FIG. 1 is a front perspective view of an exemplary luminaire.

The illustrated exemplary embodiment includes an outdoor luminaire having a housing 10 that includes a shroud 12, a front portion 14, and a rear portion 16. A mounting component 18 extends from the housing 10, for example the rear portion 16. The rear portion 16 includes a removable cover 20. The shroud 12 is positioned adjacent the front portion 14 to retain a lens 22. The housing 10 can be configured as a water proof or water resistant enclosure. Various gaskets can be positioned between the housing components as needed. The housing components can be mechanically connected to one another, for example through fasteners, threads, and/or snap-fit connections.

The front portion 14 has a front compartment and a back wall 24 that separates the front compartment from the rear portion 16. A light emitter and various control components can be positioned in the front compartment. The light emitter can include an LED board that contains one or more LEDs connected to a circuit board (not shown). The shroud 12 acts as a reflector to direct the emitted light and the size, shape, and configuration of the shroud 12 can be varied depending on the desired light output. The control components can include drivers, fuses, surge protectors, and related circuitry positioned in the front compartment to control the light emitter. The front portion 14 also includes mounting components, for example first and second bosses 26, to receive fasteners that connect the front portion 14 to the shroud 12.

The rear portion 16 extends from the front portion 14. In various exemplary embodiments, the rear portion 16 can be formed integrally with the front portion 14 or formed separately and connected thereto. The rear portion 16 includes a rear compartment 28. The cover 20 includes mounting components, for example a front set of openings 30 and a rear set of bosses 32 that receive fasteners to connect the cover 20 over the rear compartment 28. A flange 34 extends around an outer portion of the cover 20.

The rear portion 16 includes a base 40 and a side wall 42 at least partially defining the rear compartment 28. A rim 44 extends around the side wall 42 to mate with the flange 34 of the cover 20. Mounting features, for example a set of front bosses 46 and a set of rear bosses 48, are used to connect the cover 20 over the rear compartment. A conduit 50 is provided in the base 40 to allow conductors, for example mains wiring, to be run into the rear compartment. One or more strain relief clips 52 can also be provided in the rear compartment.

Figure 2:
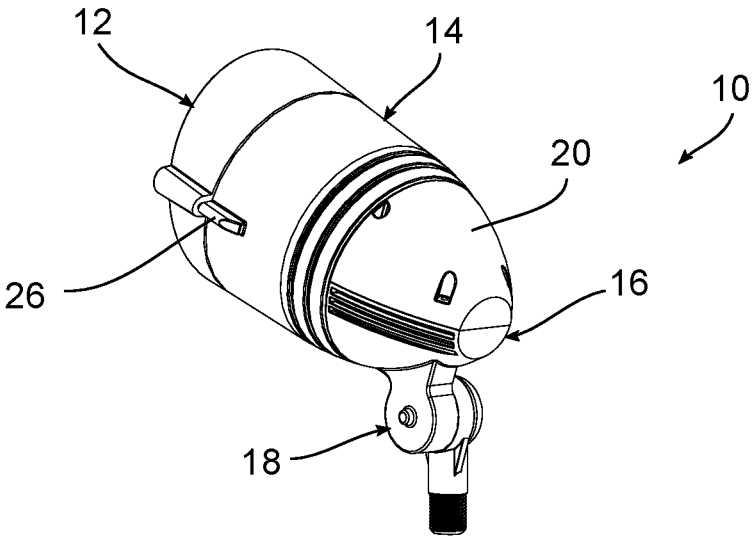
FIG. 2 is a rear perspective view of FIG. 1.
Figure 3:
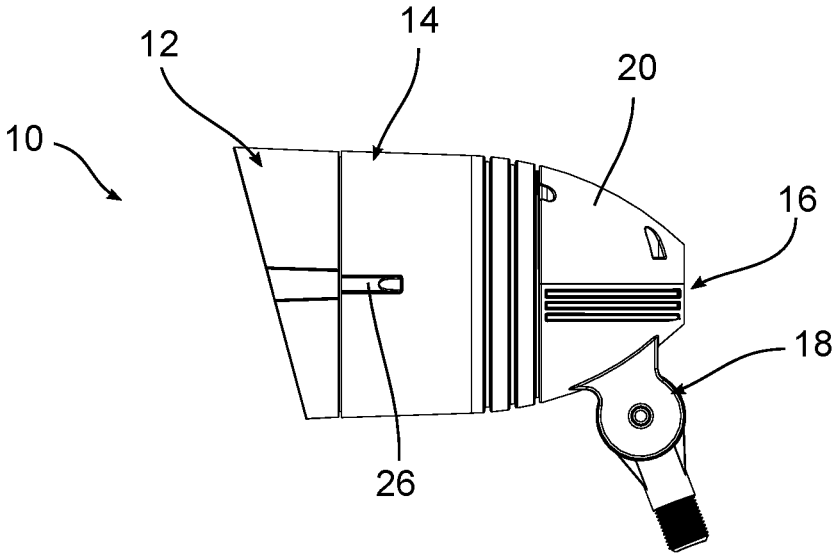
FIG. 3 is a side view of FIG. 1.
Figure 4:
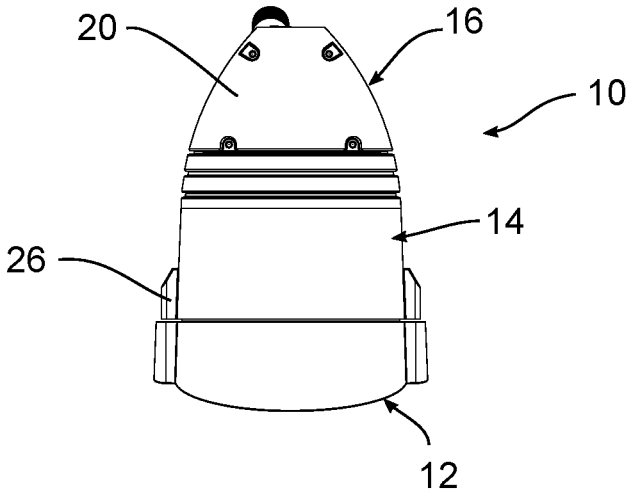
FIG. 4 is a top view of FIG. 1.
Figure 5:
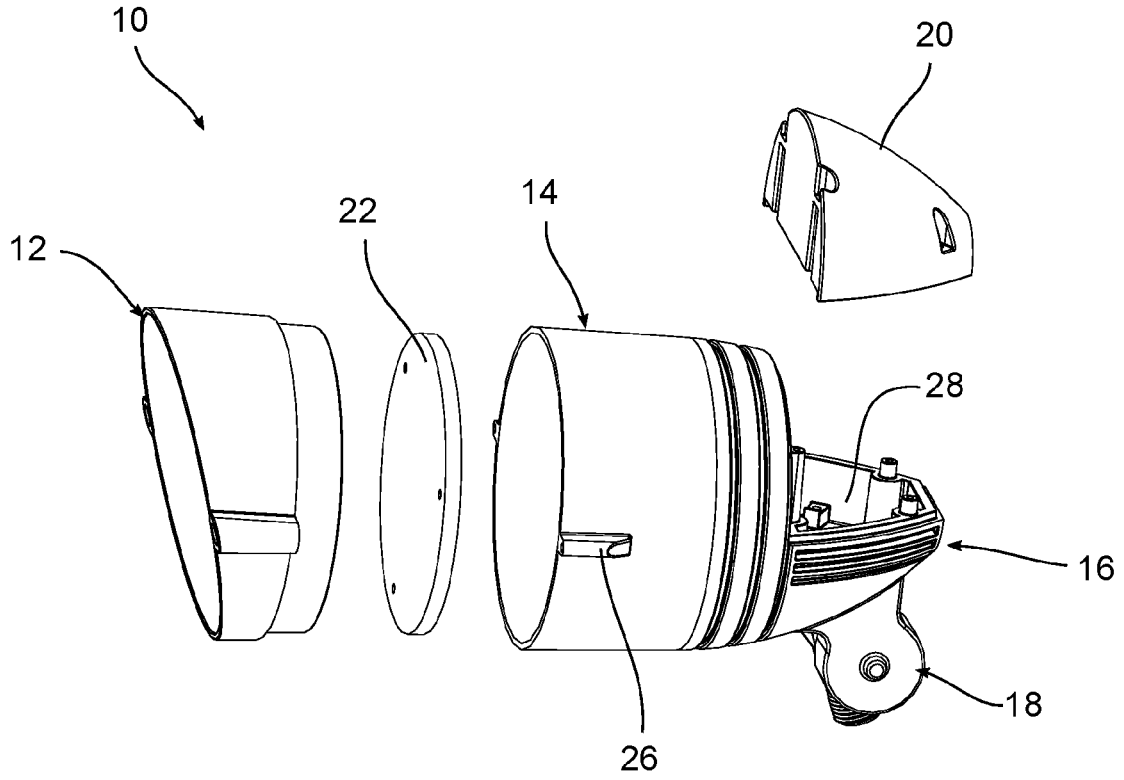
FIG. 5 is an exploded view of FIG. 1.
Figure 6:
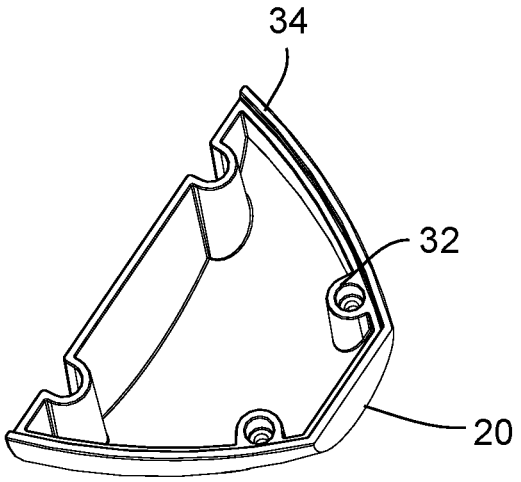
FIG. 6 is a bottom perspective view of a cover.
Figure 7:
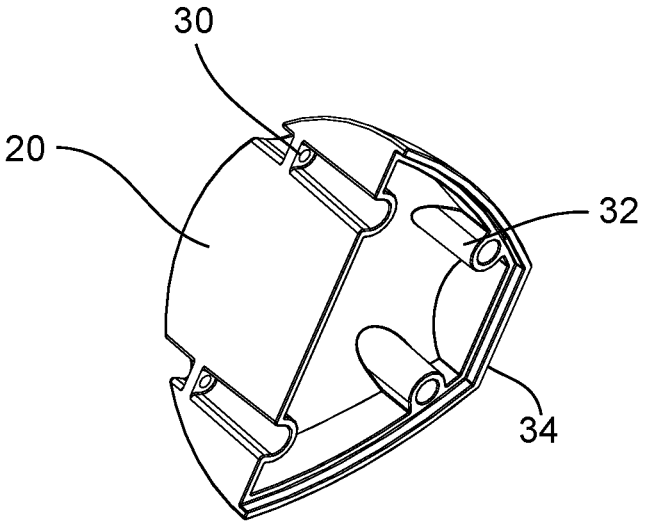
FIG. 7 is another bottom perspective view of FIG. 6.
Figure 8:
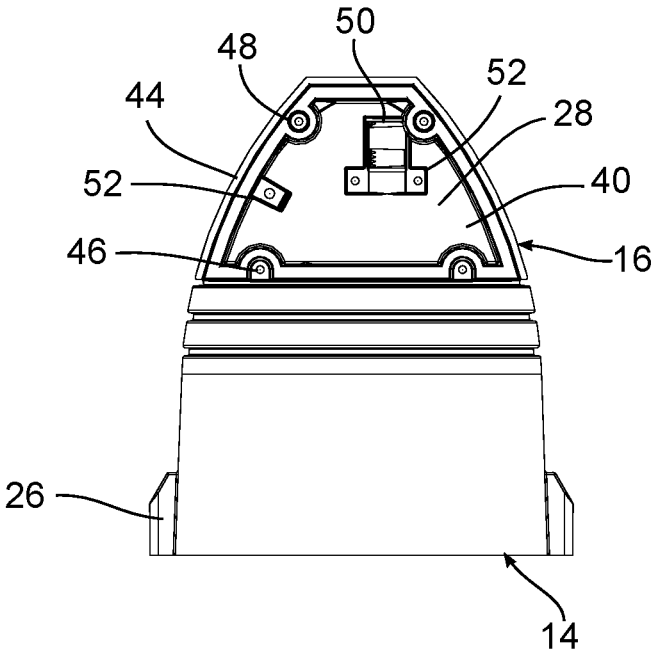
FIG. 8 is a top view of FIG. 1 with the cover removed.
Figure 9:
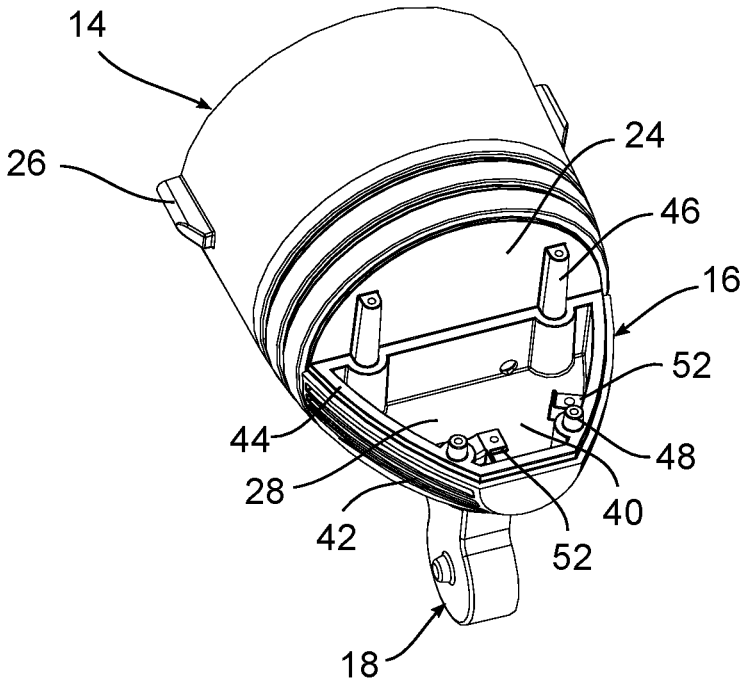
FIG. 9 is a rear perspective view of FIG. 1 with the cover removed.
Figure 10:
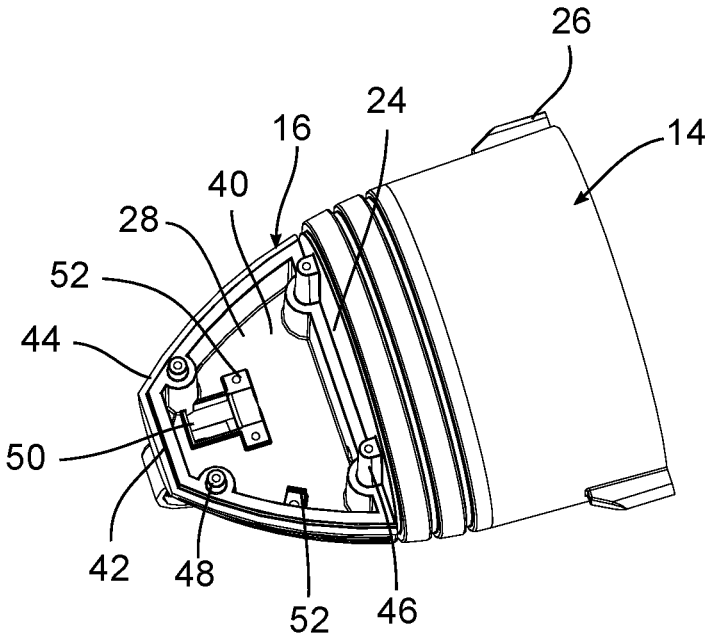
FIG. 10 is a rear perspective view of FIG. 1 with the cover removed.
Figure 11:
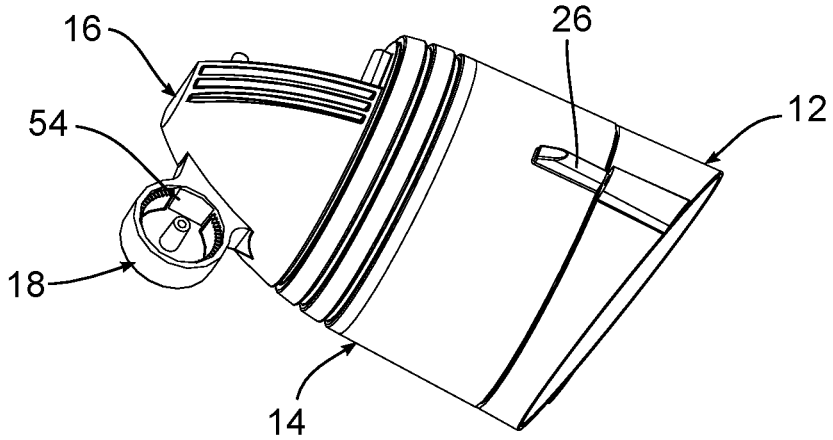
FIG. 11 is a bottom perspective view of FIG. 1 with the cover removed.

The mounting component 18 can be connected to a different mounting devices, for example the post mounting device shown in FIGS. 1-3. Other mounting devices and types of mounting components can be used as would be understood by one of ordinary skill in the art to position the luminaire 10 on the ground, wall, pole, or other surface. As best shown in FIG. 11, an opening 54 is formed in an upper portion of the mounting component 18. The opening 54 allows access to the conduit 50 in the rear portion 16 so that power supply conductors, for example mains wiring, can be run directly into the rear compartment 28.

Figure 12:
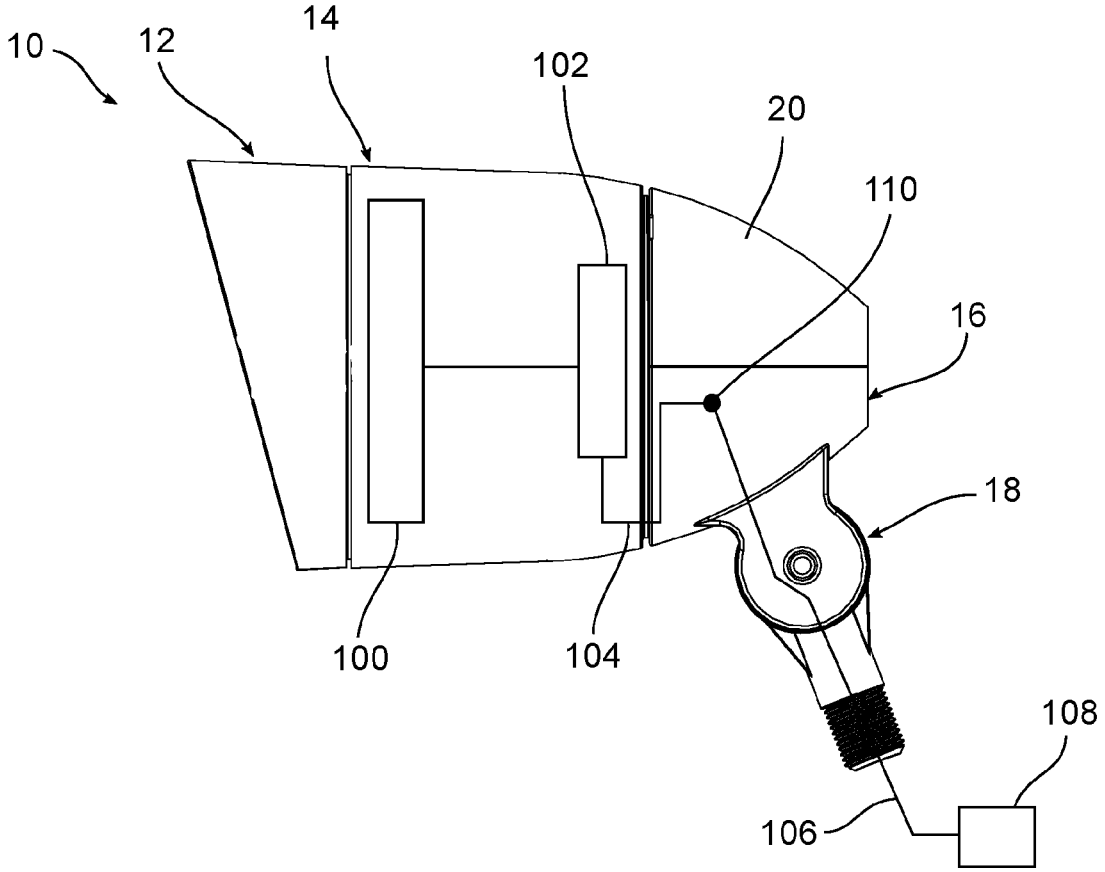
FIG. 12 is schematic diagram of the luminaire connected to a power source.

Typical directional luminaires require a junction box separated from the housing, for example under the housing in the ground, to connect the luminaire to a power source. In an exemplary embodiment, the rear portion 16 is separated from the front compartment 14 to act as a junction box. This eliminates the need for a separate junction box and allows an installer to direct greater flexibility and ease in positioning the light. FIG. 12 shows a schematic view of the housing 10 containing a light emitter 100 and a control component 102 electrically connected to the light emitter 100. One or more interior conductors 104 extend from the control component 102 in the front portion through an opening in the back wall 24 and into the rear portion 16. Power supply conductors 106 can be run from a power source 108 directly into the rear compartment 16 and spliced 110 to the interior conductors 104. The strain relief clips 52 can be used to prevent disconnection of the wiring during movement of the housing 10 or the power supply conductors 106. The interior conductors 104 and power supply conductors 106 can include one or more wires, for example hot and neutral wiring or hot, neutral, and ground wiring.

In an exemplary embodiment, a method of installing the luminaire includes positioning the luminaire at a desired location and running one or more power supply conductors 106 into the rear compartment 16. The power supply conductors 106 are then connected to one or more internal conductors 104, for example through splicing. The power supply conductors 106 can be inserted through the mounting component 18 and into the rear compartment 16 through the conduit 50.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A directional accent luminaire comprising:

a housing having a front portion including a front compartment with a front opening facing a first direction, a rear portion extending from the front portion and having a rear opening facing a second direction different from the first direction, and a wall positioned between the front portion and the rear portion;

a cover removably connected over the rear portion to cover the rear opening;

a light emitter positioned in the front compartment for emitting light through the front opening;

a control component positioned in the front compartment for controlling the light emitter; and an internal conductor electrically connected to the control component and extending from the front portion into the rear portion, wherein the rear portion includes a junction compartment for housing a connection between a power supply conductor and the internal conductor, wherein the junction compartment is positioned on an opposite side of the wall from the front portion and wherein removal of the cover provides access to the junction compartment through the rear opening.

2. The luminaire of claim 1, further comprising a shroud connected to the front portion.

3. The luminaire of claim 1, further comprising a lens positioned in front of the light emitter.

4. The luminaire of claim 1, wherein the internal conductor extends through an opening in the wall.

5. The luminaire of claim 1, wherein a strain relief clip is positioned in the junction compartment.

6. The luminaire of claim 1, wherein the rear portion includes a base and a side wall at least partially defining the junction compartment.

7. The luminaire of claim 6, wherein a conduit is provided in the base to run the power supply conductor into the junction compartment.

8. The luminaire of claim 7, further comprising a mounting component having an opening in communication with the conduit, wherein the mounting component is configured to receive a mounting device.

9. A directional accent luminaire comprising:

a housing having a front portion having a front compartment with a front opening facing a first direction, a rear portion extending from the front portion and having a rear opening facing a second direction different from the first direction, and a wall positioned between the front portion and the rear portion;

a light emitter positioned in the front compartment for emitting light through the front opening;

a control component positioned in the front compartment for controlling the light emitter;

an internal conductor electrically connected to the control component and extending from the front portion into the rear portion;

a cover removably connected over the rear portion to cover the rear opening; and a mounting component extending from the rear portion and having an opening extending therethrough in communication with the rear portion, wherein the rear portion includes a junction compartment for housing a connection between a power supply conductor and the internal conductor, wherein removal of the cover provides access to the junction compartment through the rear opening.

10. The luminaire of claim 9, further comprising a mounting device moveably connected to the mounting component.

11. The luminaire of claim 10, wherein the mounting device includes a threaded post.

12. The luminaire of claim 11, wherein the threaded post has a central opening for receiving a conductor and is in communication with the mounting component opening.

13. The luminaire of claim 9, wherein the internal conductor extends through an aperture in the wall.

14. The luminaire of claim 9, wherein a strain relief clip is positioned in the junction compartment.

15. The luminaire of claim 9, wherein the rear portion includes a base and a side wall at least partially defining the junction compartment.

16. The luminaire of claim 15, wherein a conduit is provided in the base in communication with the mounting component opening to run the power supply conductor into the junction compartment.

17. The luminaire of claim 9, further comprising a shroud removeably connected to the front portion.

18. The luminaire of claim 9, further comprising a lens positioned in front of the light emitter.

19. The luminaire of claim 9, further comprising a power supply conductor spliced to the interior conductor in the junction compartment.

20. A method of installing a directional accent luminaire comprising:

extending a power supply conductor through a mounting device;

positioning a luminaire near the mounting device, the luminaire comprising a housing having a front portion having a front compartment with a front opening facing a first direction, a rear portion extending from the front portion, the rear portion having a rear opening facing a second direction different from the first direction and having a junction compartment, and a wall positioned between the front portion and the rear portion, a light emitter positioned in the front compartment for emitting light, a control component positioned in the front compartment for controlling the light emitter, an internal conductor electrically connected to the control component and extending from the front portion into the rear portion, and a mounting component extending from the rear portion having an opening extending therethrough and in communication with the rear portion;

running the power supply conductor through the mounting component and into the junction compartment;

splicing the power supply conductor to the internal conductor in the junction compartment;

connecting a cover to the rear portion over the junction compartment, wherein removal of the cover provides access to the junction compartment through the rear opening; and connecting the mounting device to the mounting component, where the mounting device is rotatably connected to the mounting component.

* * * * *